US009281582B2

(12) United States Patent
Hou et al.

(10) Patent No.: US 9,281,582 B2
(45) Date of Patent: Mar. 8, 2016

(54) RECEPTACLE OF ELECTRICAL CONNECTOR

(71) Applicant: Advanced-Connectek Inc., New Taipei (TW)

(72) Inventors: Pin-Yuan Hou, New Taipei (TW); Ya-Fen Kao, New Taipei (TW); Yu-Lun Tsai, New Taipei (TW); Wen-Yu Wang, New Taipei (TW); Wen-Hsien Tsai, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 5 days.

(21) Appl. No.: 14/287,152

(22) Filed: May 26, 2014

(65) Prior Publication Data

US 2015/0111433 A1 Apr. 23, 2015

(30) Foreign Application Priority Data

Oct. 18, 2013 (TW) ..... 102219533 U

(51) Int. Cl.

| | |
|---|---|
| ***H01R 24/00*** | (2011.01) |
| ***H01R 12/70*** | (2011.01) |
| ***H01R 12/72*** | (2011.01) |
| ***H01R 13/405*** | (2006.01) |
| ***H01R 13/514*** | (2006.01) |
| *H01R 13/6594* | (2011.01) |
| *H01R 24/60* | (2011.01) |

(52) U.S. Cl.

CPC ..... *H01R 12/707* (2013.01); *H01R 12/724* (2013.01); *H01R 13/405* (2013.01); *H01R 13/514* (2013.01); *H01R 13/6594* (2013.01); *H01R 24/60* (2013.01)

(58) Field of Classification Search

CPC ..... H01R 13/46; H01R 24/60
USPC ..... 439/626, 660, 607.48, 604.41, 607.55
See application file for complete search history.

(56) References Cited

U.S. PATENT DOCUMENTS

| | | | | |
|---|---|---|---|---|
| 6,368,155 | B1 * | 4/2002 | Bassler | H01R 13/6616 340/650 |
| 7,938,659 | B1 * | 5/2011 | Zhu | H01R 13/502 439/218 |
| 8,801,469 | B2 * | 8/2014 | Wu | H01R 13/6477 439/607.01 |
| 8,801,470 | B2 * | 8/2014 | Hsueh | H01R 4/023 439/607.01 |
| 8,814,583 | B2 * | 8/2014 | Naito | H01R 24/60 439/188 |
| 2005/0014418 | A1 * | 1/2005 | Ji | H01R 4/023 439/660 |
| 2005/0186843 | A1 * | 8/2005 | Tsai | H01R 23/6873 439/607.36 |

(Continued)

*Primary Examiner* — Abdullah Riyami
*Assistant Examiner* — Nader J Alhawamdeh
(74) *Attorney, Agent, or Firm* — Alan D. Kamrath; Kamrath IP Lawfirm, P.A.

(57) ABSTRACT

A receptacle for an electrical connector includes a metal housing body, a plastic main body positioned in the metal housing body, and flat terminals. The plastic main body incorporates with the metal housing body to form an accommodating space for being plugged into by a plug. First and second tongue parts disposed on the plastic main body are respectively close to upper and lower sides of the metal housing body. Each flat terminal includes a fixing part, a contacting part formed in a flat shape, and a soldering part. The contacting parts are respectively disposed on first and second tongue parts and respectively are exposed to the accommodating space in downward and upward directions. A tongue of a plastic body of the receptacle, i.e. first and second tongue parts, and the flat terminals are thus minimally damaged, to prevent the expensive cost of repairing a damaged receptacle.

19 Claims, 11 Drawing Sheets

(56) References Cited

U.S. PATENT DOCUMENTS

2009/0305532 A1* 12/2009 Hou ..... H01R 12/712 439/83
2012/0156938 A1* 6/2012 Zhang ..... H01R 13/6461 439/660
2012/0315796 A1* 12/2012 Pang ..... H01R 13/6471 439/626
2013/0178094 A1* 7/2013 Huang ..... H01R 24/60 439/490
2013/0196544 A1* 8/2013 Little ..... H01R 12/71 439/626
2013/0225010 A1* 8/2013 Naito ..... H01R 24/60 439/676
2014/0213114 A1* 7/2014 Isoda ..... H01R 11/07 439/626
2015/0072562 A1* 3/2015 Little ..... H01R 13/6658 439/607.55

* cited by examiner

RECEPTACLE OF ELECTRICAL CONNECTOR

BACKGROUND OF THE INVENTION

1. Field of the Invention

The present invention relates to an electrical connector and, more particularly, to a receptacle for an electrical connector and a plug matching the same. In general, a receptacle and a plug for an electrical connector are also known as a receptacle connector and a plug connector.

2. Description of the Prior Art

Either a receptacle or a plug of an electrical connector, e.g. a universal serial bus (USB) connector matching the standard USB 3.0, comprises a plastic body with a tongue, flat terminals (i.e. each terminal comprise a contacting part utilized for contacting another terminal and having a flat shape), and elastic terminals (i.e. each terminal comprise a contacting part utilized for contacting another terminal and having an elastic arm shape). The elastic terminals or the tongue of the plastic body are easily damaged due to abnormal usage, such as plugging the plug in a receptacle that does not match. A repairman needs to take a main board out of a device to replace a damaged receptacle when the elastic terminals or the tongue of the plastic body of the receptacle are damaged. Therefore, a cost for repair is high. The shielding structures of the housings of the receptacle and the plug of the USB connectors have a poor design and easily cause radio frequency interference. When radio frequency interference happens, devices like wireless mouses or blue tooth gadgets do not function properly.

SUMMARY OF THE INVENTION

The present invention provides a receptacle for an electrical connector, in which a plurality of terminals and a tongue for a plastic body are minimally damaged, to prevent expensive cost of repairing a damaged receptacle.

According to disadvantages in the prior art, the present invention also provides a plug matching the receptacle for the electrical connector set forth. Shielding structures of housings of the receptacle and the plug have a better design and cause minimal radio frequency interference, to prevent interference between devices.

According to the invention, the receptacle for the electrical connector comprises a metal housing body, a plastic main body, and a plurality of flat terminals. The plastic main body is positioned within the metal housing body and incorporates with the metal housing body to form an accommodating space. The accommodating space is utilized for being plugged into by a plug matching the receptacle. Each flat terminal comprises a fixing part, a contacting part, and a soldering part. The fixing part of the flat terminal is fixed within the plastic main body. The contacting part of the flat terminal extends from the fixing part of the flat terminal in a forward direction to form a flat shape and to expose the accommodating space. The soldering part of the flat terminal extends from the fixing part of the flat terminal in a downward direction and outside the plastic main body.

According to an embodiment of the claimed invention, the flat terminals are fixed in the plastic main body in an insert molding manner or in an assembly manner.

According to another embodiment of the invention, the flat terminals comprise a plurality of first flat terminals and a plurality of second flat terminals. Signals provided by the first flat terminals are the same as those provided by the second flat terminals, and an alignment sequence of the first flat terminals compared to that of the second flat terminals is in reverse order.

According to another embodiment of the invention, the soldering parts of the first flat terminals and the second flat terminals utilize a surface mount technology (SMT) manner. The soldering parts of the first flat terminals and the second flat terminals utilize a dual in-line package (DIP) manner, or the soldering parts of the first flat terminals utilize a SMT manner, and the soldering parts of the second flat terminals utilize a DIP manner.

According to another embodiment of the invention, the plastic main body comprises a first plastic body and a second plastic body. The first plastic body comprises a first connecting part and a first tongue part extending from an upper edge of the first connecting part in a forward direction. The second plastic body comprises a second connecting part and a second tongue part extending from a lower edge of the second connecting part in a forward direction. The first plastic body and the second plastic body are connected to each other by the first connecting part and the second connecting part to form the plastic main body. The fixing part of each first flat terminal is fixed in the first connecting part. The contacting part of each first flat terminal is disposed on the first tongue part and is exposed to the accommodating space in a downward direction. The soldering part of each first flat terminal extends from the fixing part of the first flat terminal in a downward direction and outside the first connecting part. The fixing part of each second flat terminal is fixed in the second connecting part. The contacting part of each second flat terminal is disposed on the second tongue part and is exposed to the accommodating space in an upward direction. The soldering part of each second flat terminal extends from the fixing part of the second flat terminal in a downward direction and outside the second connecting part.

According to another embodiment of the invention, the plug matching the receptacle comprises a metal housing component, a plastic component, a plurality of first elastic terminals, a plurality of second elastic terminals, and a metal shielding plate. The metal housing component comprises a housing, a front plate, a left plate, a right plate, an upper plate, and a lower plate. Each of the front plate, the left plate, the right plate, the upper plate, and the lower plate comprises a first edge, a second edge, a third edge, and a fourth edge. The first edge and the second edge are opposite each other, and the third edge and the fourth edge are opposite each other. Two ends of the first edge are respectively connected to one end of the third edge and to one end of the fourth edge, and two ends of the second edge are respectively connected to the other ends of the third edge and the fourth edge. A left edge and a right edge of an opening at the front of the housing are respectively connected to the first edges of the left plate and the right plate. The second edges of the left plate and the right plate are respectively connected to the first edge and the second edge of the front plate.

An upper edge and a lower edge of the opening at the front of the housing are respectively connected to the first edges of the upper plate and the lower plate. The third edge and the fourth edge of the upper plate are respectively connected to parts of the third edges of the left plate and the right plate, and the third edge and the fourth edge of the lower plate are respectively connected to parts of the fourth edges of the left plate and the right plate. The second edge of the upper plate, the other parts of the third edges of the left plate and the right plate, and the third edge of the front plate incorporate with each other to form a first opening. The second edge of the lower plate, the other parts of the fourth edges of the left plate and the right plate, and the fourth edge of the front plate incorporate with each other to form a second opening.

The plastic component inserts in an opening at the back of the housing and is disposed in the metal housing component. Each first elastic terminal is disposed on an upper side of the plastic component and comprises a fixing part, a contacting part, and a soldering part. The fixing part of the first elastic terminal is fixed in the plastic component. The contacting part of the first elastic terminal extends from the fixing part of the first elastic terminal in a forward direction to form an elastic arm shape, is exposed to the first opening in an upward direction, and is not higher than the third edges of the left plate and the right plate. The soldering part of the first elastic terminal extends from the fixing part of the first elastic terminal in a backward direction and outside the plastic component. Each second elastic terminal is disposed on a lower side of the plastic component and comprises a fixing part, a contacting part, and a soldering part. The fixing part of the second elastic terminal is fixed in the plastic component.

The contacting part of the second elastic terminal extends from the fixing part of the second elastic terminal in a forward direction to form an elastic arm shape, is exposed to the second opening in a downward direction, and is not lower than the fourth edges of the left plate and the right plate. The soldering part of the second elastic terminal extends from the fixing part of the second elastic terminal in a backward direction and outside the plastic component. The metal shielding plate is disposed in the plastic component and is positioned between the first elastic terminals and the second elastic terminals.

In the embodiment, a plurality of elastic arms is respectively disposed on a right side, on a left side, and on at least one of an upper side and a lower side of the metal housing body of the receptacle. Therefore, when the plug is plugged in the receptacle, the receptacle is connected to the left plate, the right plate, and at least one of the upper plate and the lower plate of the metal housing component of the plug in a tight fit manner. In addition, two first troughs are respectively disposed on two sides of a lower side of the first tongue part, and two second troughs are respectively disposed on two sides of an upper side of the second tongue part. Therefore, when the plug is plugged in the receptacle, the first troughs and the second troughs of the receptacle respectively accommodate the third edges and the fourth edges of the left plate and the right plate of the metal housing component of the plug.

According to another embodiment of the claimed invention, the plug matching the receptacle comprises a metal housing component, a plastic component, a plurality of first elastic terminals, a plurality of second elastic terminals, and a metal shielding plate. The metal housing component comprises a housing, a front plate, a left plate, and a right plate. Each of the front plate, the left plate, and the right plate comprises a first edge, a second edge, a third edge, and a fourth edge. The first edge and the second edge are opposite each other, and the third edge and the fourth edge are opposite each other. Two ends of the first edge are respectively connected to one end of the third edge and to one end of the fourth edge, and two ends of the second edge are respectively connected to the other ends of the third edge and the fourth edge. A left edge and a right edge of an opening at the front of the housing are respectively connected to the first edges of the left plate and the right plate, and the second edges of the left plate and the right plate are respectively connected to the first edge and the second edge of the front plate. An upper edge of the opening at the front of the housing, the third edges of the left plate and the right plate, and the third edge of the front plate incorporate with each other to form a first opening. A lower edge of the opening at the front of the housing, the fourth edges of the left plate and the right plate, and the fourth edge of the front plate incorporate with each other to form a second opening.

The plastic component inserts in an opening at the back of the housing and is disposed in the metal housing component. Each first elastic terminal is disposed on an upper side of the plastic component and comprises a fixing part, a contacting part, and a soldering part. The fixing part of the first elastic terminal is fixed in the plastic component. The contacting part of the first elastic terminal extends from the fixing part of the first elastic terminal in a forward direction to form an elastic arm shape, is exposed to the first opening in an upward direction, and is not higher than the third edges of the left plate and the right plate. The soldering part of the first elastic terminal extends from the fixing part of the first elastic terminal in a backward direction and outside the plastic component. Each second elastic terminal is disposed on a lower side of the plastic component and comprises a fixing part, a contacting part, and a soldering part. The fixing part of the second elastic terminal is fixed in the plastic component. The contacting part of the second elastic terminal extends from the fixing part of the second elastic terminal in a forward direction to form an elastic arm shape, is exposed to the second opening in a downward direction, and is not lower than the fourth edges of the left plate and the right plate.

The soldering part of the second elastic terminal extends from the fixing part of the second elastic terminal in a backward direction and outside the plastic component. The metal shielding plate is disposed in the plastic component and is positioned between the first elastic terminals and the second elastic terminals. In the embodiment, a plurality of elastic arms is disposed on a right side and a left side of the metal housing body of the receptacle. Therefore, when the plug is plugged in the receptacle, the receptacle is connected to the left plate and the right plate of the metal housing component of the plug in a tight fit manner.

In addition, two first troughs are disposed on a lower side of the first tongue part of the receptacle and are opposite each other, and two second troughs are disposed on an upper side of the second tongue part and are opposite each other. Therefore, when the plug is plugged in the receptacle, the first troughs and the second troughs of the receptacle respectively accommodate the third edges and the fourth edges of the left plate, and the right plate of the metal housing component of the plug. In addition, the plug may further comprise an accommodating housing. A front end of the accommodating housing is coupled with a back end of the metal housing component. Two elastic arms respectively extend from an upper edge and a lower edge of the accommodating housing in a forward direction. Therefore, when the plug is plugged in the receptacle, the plug is connected to an upper side and a lower side of the metal housing body in a tight fit manner. Alternately, two elastic arms respectively extend from the upper edge and the lower edge of the opening at the front of the housing of the metal housing component in a forward direction. Therefore, when the plug is plugged in the receptacle, the plug is connected to the upper side and the lower side of the metal housing body in a tight fit manner.

According to another embodiment of the invention, the plastic main body comprises a first plastic body and a second plastic body. The first plastic body comprises a first connecting part. The second plastic body comprises a second connecting part and a tongue part extending from a middle of the second connecting part in a forward direction. The first plastic body and the second plastic body are connected to each other by the first connecting part and the second connecting part to form the plastic main body. The fixing part of each first flat terminal is fixed in the first connecting part.

The contacting part of each first flat terminal is disposed on the tongue part and is exposed to the accommodating space in an upward direction. The soldering part of each first flat terminal extends from the fixing part of the first flat terminal in a downward direction and outside the first connecting part. The fixing part of each second flat terminal is fixed in the second connecting part. The contacting part of each second flat terminal is disposed on the tongue part and is exposed to the accommodating space in a downward direction. The soldering part of each second flat terminal extends from the fixing part of the second flat terminal in a downward direction and outside the second connecting part.

Any one of the manners in the embodiments set forth can be applied to each other to become a new embodiment as long as the manners do not contradict.

The tongues of the plastic bodies of the receptacles of the electrical connector of the present invention, i.e. the first tongue part of the first plastic body and the second tongue part of the second plastic body, are close to the upper side and to the lower side of the metal housing body, and to the terminals of the receptacle, i.e. the first flat terminals and the second flat terminals, have a flat shape. Therefore, the damage to the receptacle due to abnormal usage, such as plugging a plug in an unmatched receptacle, rarely happens, to prevent the expensive cost of repairing a damaged receptacle.

These and other objectives of the present invention will become obvious to those of ordinary skill in the art after reading the following detailed description of the preferred embodiments that are illustrated in the various figures and drawings.

DETAILED DESCRIPTION

Figure 1:
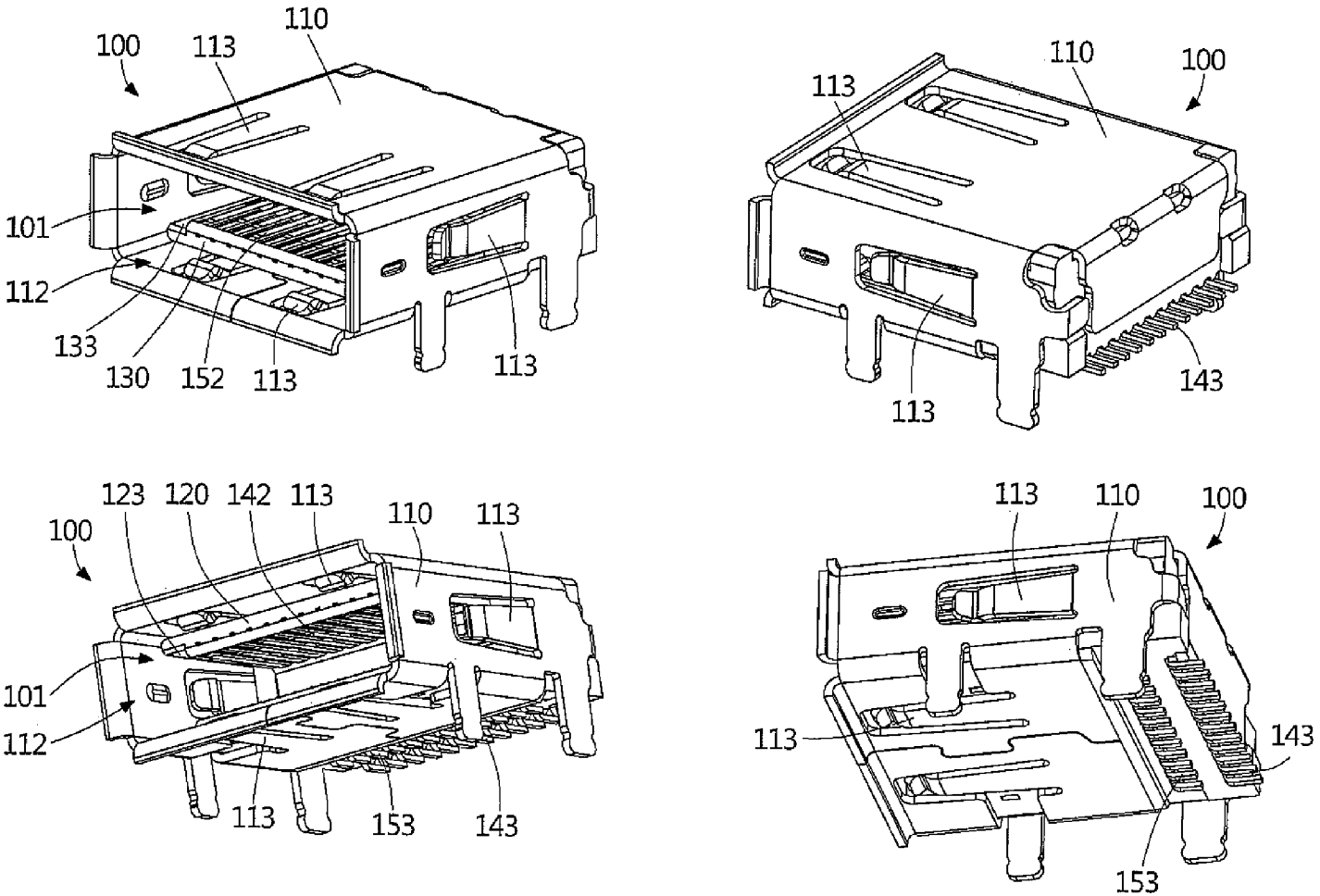
FIG. 1 is a diagram with different angles of view of a receptacle of an electrical connector according to the first embodiment of the present invention.

In the embodiments below, the same or similar reference characters represent the same or similar components. In addition, directional terms described in the embodiments are merely used for reference and illustration according to the drawings. Therefore, the directional terms shall not limit the scope of the invention.

Figure 2:
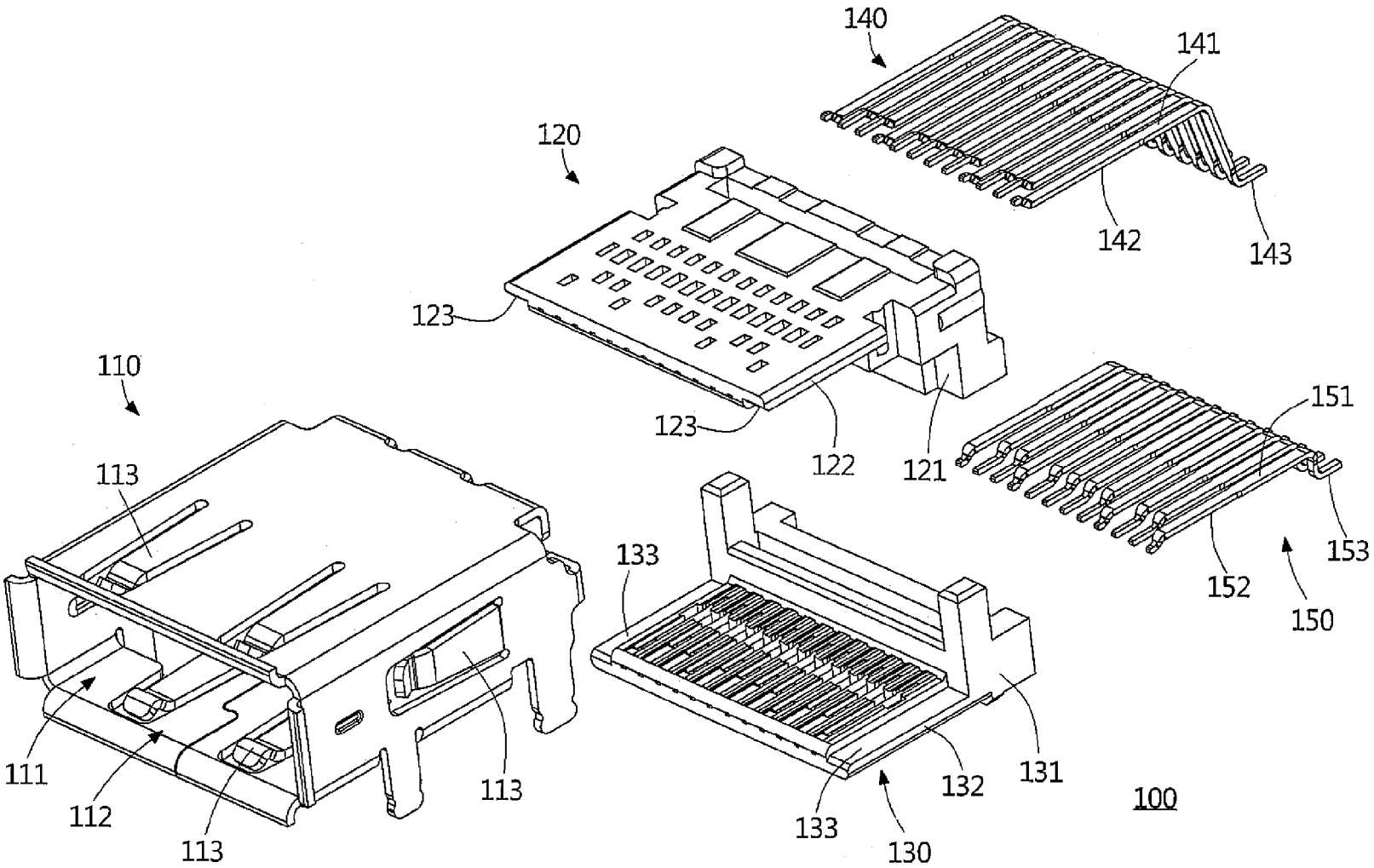
FIG. 2 is an exploded view of the receptacle of the electrical connector according to the first embodiment of the present invention.
Figure 3:
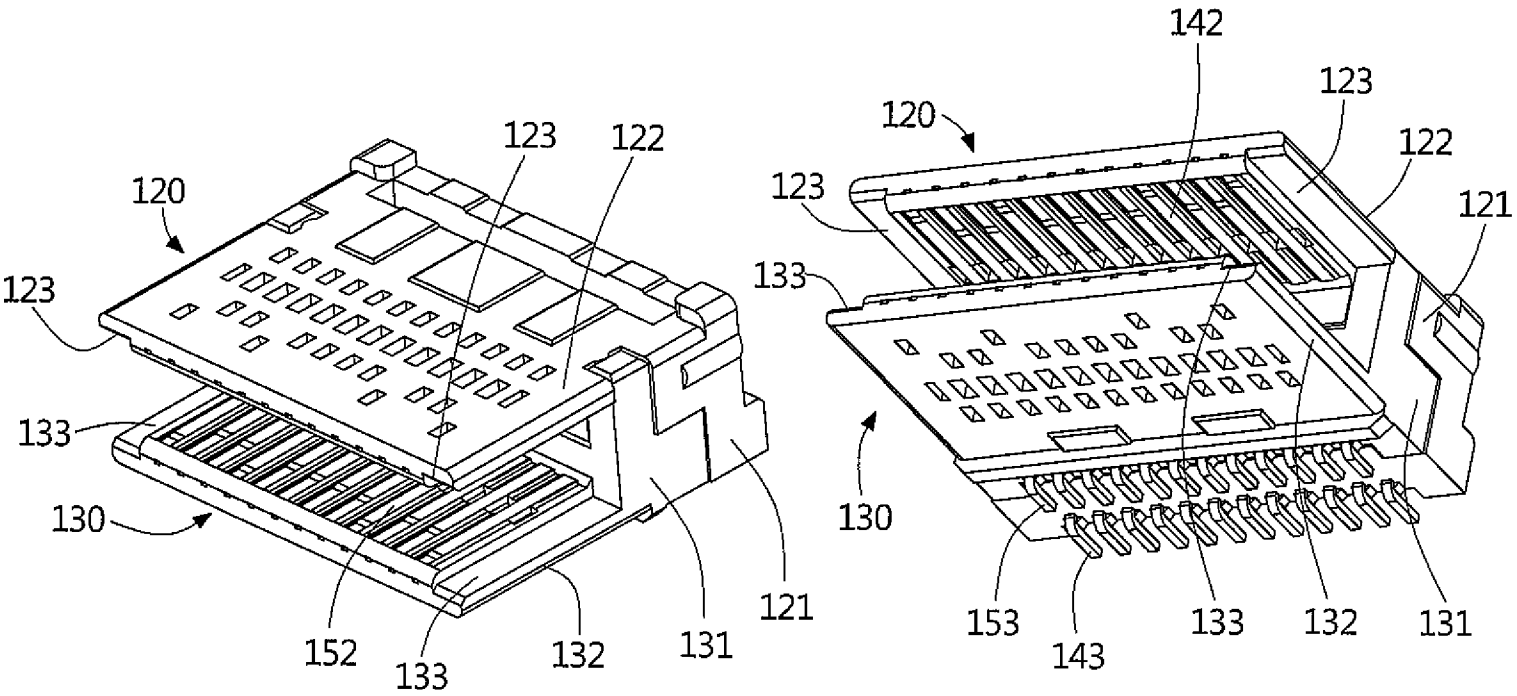
FIG. 3 is a diagram of an assembly of a first and a second plastic body of the receptacle of the electrical connector according to the first embodiment of the present invention.

As shown in FIG. 1 to FIG. 3, a receptacle 100 of an electrical connector according to the first embodiment of the invention comprises a metal housing body 110, a plastic main body, and a plurality of flat terminals. The plastic main body comprises, but is not limited to, a first plastic body 120 and a second plastic body 130. In another embodiment, a plastic main body can be formed as a one-piece component, instead of being formed by connecting the first plastic body 120 to the second plastic body 130. The flat terminals comprise a plurality of first flat terminals 140 and a plurality of second flat terminals 150. The metal housing body 110 comprises an accommodating space 111 and an opening 112 connecting to the accommodating space 111. A right side, a left side, an upper side, and a lower side of the metal housing body 110 respectively comprise at least one elastic arm 113 utilized for clamping and fixing a plug which matches and is plugged in the receptacle 100.

The first plastic body 120 comprises a first connecting part 121 and a first tongue part 122 extending from an upper edge of the first connecting part 121 in a forward direction. The second plastic body 130 comprises a second connecting part 131 and a second tongue part 132 extending from a lower edge of the second connecting part 131 in a forward direction. The first plastic body 120 and the second plastic body 130 are connected to each other by the first connecting part 121 and the second connecting part 131 to form the plastic main body, as shown in FIG. 3. The plastic main body is positioned in the accommodating space 111 of the metal housing body 110 and incorporates with the metal housing body 110 to form an accommodating space 101. The plug matching the receptacle 100 can be inserted through the opening 112 and be plugged in the accommodating space 101.

Each first flat terminal 140 comprises a fixing part 141, a contacting part 142, and a soldering part 143. The fixing part 141 is fixed in the first connecting part 121. The contacting part 142 extends from the fixing part 141 in a forward direction to form a flat shape. The contacting part 142 is disposed on a lower side of the first tongue part 122 and is exposed to the accommodating space 101 in a downward direction. The soldering part 143 extends from the fixing part 141 in a downward direction and outside the first connecting part 121. Each second flat terminal 150 comprises a fixing part 151, a contacting part 152, and a soldering part 153. The fixing part 151 is fixed in the second connecting part 131. The contacting part 152 extends from the fixing part 151 in a forward direction to form a flat shape. The contacting part 152 is disposed on an upper side of the second tongue part 132 and is exposed to the accommodating space 101 in an upward direction. The soldering part 153 extends from the fixing part 151 in a downward direction and outside the second connecting part 131.

A tongue of a plastic body of the receptacle 100 of the present invention, i.e. the first tongue part 122 of the first plastic body 120 and the second tongue part 132 of the second plastic body 130, is close to the upper side and to the lower side of the metal housing body 110. Compared to a prior receptacle of an electrical connector, e.g. a USB connector, of which a tongue of a plastic body is positioned at a middle of a metal housing body, the tongue of the plastic body of the receptacle 100 of the invention is minimally damaged due to abnormal usage, such as plugging a plug in an unmatched receptacle, to prevent the expensive cost of repairing a damaged receptacle. In addition, each of the terminals of the receptacle 100 of the invention, i.e. the first flat terminals 140 and the second flat terminals 150, has a flat shape. Compared to a prior receptacle of an electrical connector, e.g. a USB connector, of which a plurality of terminals comprise elastic terminals, the terminals of the receptacle 100 of the invention are minimally damaged due to abnormal usage, such as plugging a plug in an unmatched receptacle, to prevent the expensive cost of repairing a damaged receptacle.

In the embodiment, signals provided by the first flat terminals 140 of the receptacle 100 are the same as those provided by the second flat terminals 150 of the receptacle 100. The alignment sequence of the first flat terminals 140 compared to that of the second flat terminals 150 is in reverse order. In other words, signals provided by the first flat terminals 140 in left to right order are the same as those provided by the second flat terminals 150 in right to left order. Therefore, the plug matching the receptacle 100 can be plugged therein and works well whether or not the plug is upside down. The first flat terminals 140 and the second flat terminals 150 are, but are not limited to, respectively fixed in the first plastic body 120 and the second plastic body 130 of the plastic main body in an insert molding manner. In another embodiment, the first flat terminals and/or the second flat terminals can be fixed in the plastic main body in an assembly manner. The soldering parts of the first flat terminals 140 and the second flat terminals 150 utilize, but are not limited to, a surface mount technology (SMT) manner, and as a result, the terminals have better coplanarity. In another embodiment, the soldering parts of the first flat terminals and the second flat terminals utilize a dual in-line package (DIP) manner, and as a result, the terminals have better retention when being soldered on a circuit board. Furthermore, the soldering parts of the first flat terminals can utilize a SMT manner, and the soldering parts of the second flat terminals can utilize a DIP manner. As a result, the terminals have better coplanarity, better retention when being soldered on a circuit board, and better ability to be reworked compared to terminals that utilize the SMT manner.

Figure 4:
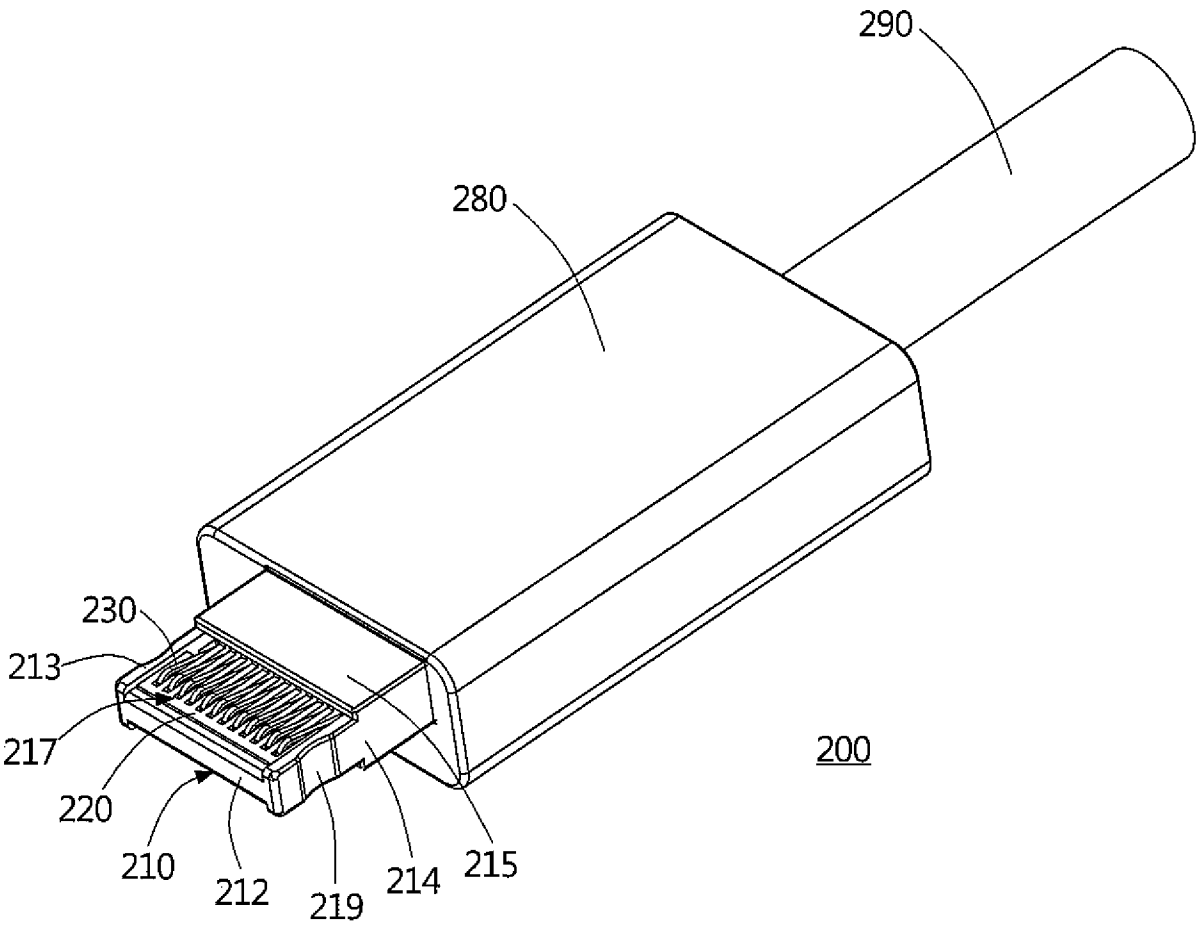
FIG. 4 is a diagram of a plug of the electrical connector according to the first embodiment of the present invention.
Figure 5:
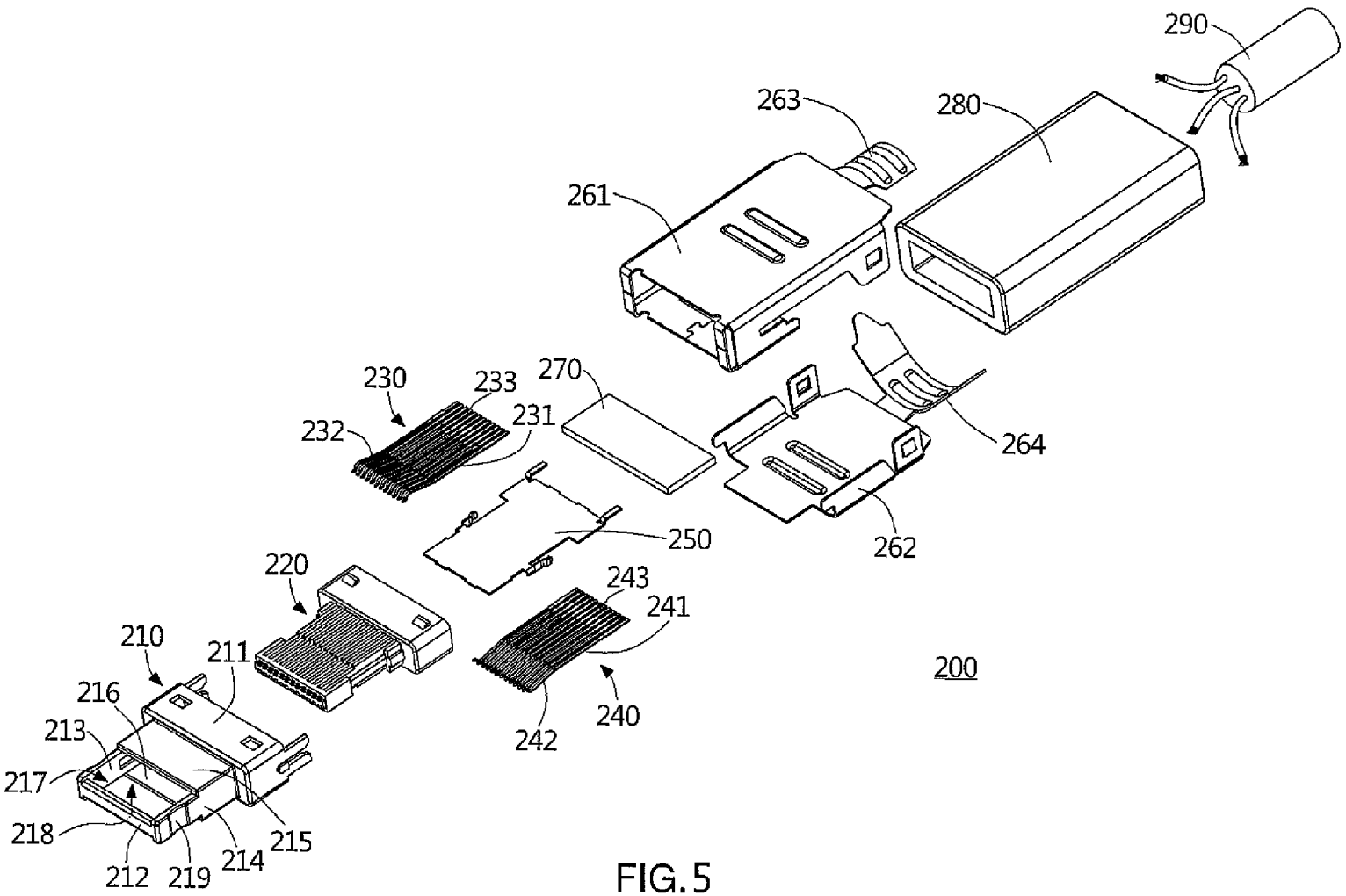
FIG. 5 is an exploded view of the plug of the electrical connector according to the first embodiment of the present invention.

As shown in FIG. 4 and FIG. 5, a plug 200 of the electrical connector according to the first embodiment of the invention matches the receptacle 100. The plug 200 comprises a metal housing component 210, a plastic component 220, a plurality of first elastic terminals 230, a plurality of second elastic terminals 240, and a metal shielding plate 250. The metal housing component 210 comprises a housing 211, a front plate 212, a left plate 213, a right plate 214, an upper plate 215, and a lower plate 216. Each of the front plate 212, the left plate 213, the right plate 214, the upper plate 215, and the lower plate 216 comprises a first edge, a second edge, a third edge, and a fourth edge.

The first edge and the second edge are opposite to each other, and the third edge and the fourth edge are opposite to each other. Two ends of the first edge are respectively connected to one end of the third edge and to one end of the fourth edge, and two ends of the second edge are respectively connected to the other ends of the third edge and the fourth edge. A left edge and a right edge of an opening at the front of the housing 211 are respectively connected to the first edges of the left plate 213 and the right plate 214. The second edges of the left plate 213 and the right plate 214 are respectively connected to the first edge and the second edge of the front plate 212. An upper edge and a lower edge of the opening at the front of the housing 211 are respectively connected to the first edges of the upper plate 215 and the lower plate 216. The third edge and the fourth edge of the upper plate 215 are respectively connected to parts of the third edges of the left plate 213 and the right plate 214, and the third edge and the fourth edge of the lower plate 216 are respectively connected to parts of the fourth edges of the left plate 213 and the right plate 214. The second edge of the upper plate 215, the other parts of the third edges of the left plate 213 and the right plate 214, and the third edge of the front plate 212 incorporate with each other to form a first opening 217. The second edge of the lower plate 216, the other parts of the fourth edges of the left plate 213 and the right plate 214, and the fourth edge of the front plate 212 incorporate with each other to form a second opening 218. The plastic component 220 inserts into an opening at the back of the housing 211 and is disposed in the metal housing component 210.

Each first elastic terminal 230 is disposed on an upper side of the plastic component 220 and comprises a fixing part 231, a contacting part 232, and a soldering part 233. The fixing part 231 is fixed in the plastic component 220. The contacting part 232 extends from the fixing part 231 in a forward direction to form an elastic arm shape, is exposed to the first opening 217 in an upward direction, and is not higher than the third edges of the left plate 213 and the right plate 214. The soldering part 233 extends from the fixing part 231 in a backward direction and outside the plastic component 220. Each second elastic terminal 240 is disposed on a lower side of the plastic component 220 and comprises a fixing part 241, a contacting part 242, and a soldering part 243. The fixing part 241 is fixed in the plastic component 220. The contacting part 242 extends from the fixing part 241 in a forward direction to form an elastic arm shape, is exposed to the second opening 218 in a downward direction, and is not lower than the fourth edges of the left plate 213 and the right plate 214.

The soldering part 243 extends from the fixing part 241 in a backward direction and outside the plastic component 220. Since the contacting part 232 with the elastic arm shape of the first elastic terminal 230 is not higher than the third edges of the left plate 213 and the right plate 214 in an upward direction, and since the contacting part 242 with the elastic arm shape of the second elastic terminal 240 is not lower than the fourth edges of the left plate 213 and the right plate 214 in a downward direction, the first elastic terminals 230 and the second elastic terminals 240 can be protected by the left plate 213 and the right plate 214. In addition, as shown in FIG. 1 to FIG. 3, two first troughs 123 are respectively disposed on two sides of the lower side of the first tongue part 122 of the receptacle 100, and two second troughs 133 are respectively disposed on two sides of the upper side of the second tongue part 132. Therefore, when the plug 200 is plugged in the receptacle 100, the first troughs 123 and the second troughs 133 of the receptacle 100 respectively accommodate the third edges and the fourth edges of the left plate 213 and the right plate 214 of the metal housing component 210 of the plug 200. The metal shielding plate 250 is disposed in the plastic component 220 and is positioned between the first elastic terminals 230 and the second elastic terminals 240 to effectively suppress crosstalk between the first elastic terminals 230 and the second elastic terminals 240 and to improve the efficiency and stability of signal transmission.

When the plug 200 of the invention is plugged in the receptacle 100, the elastic arms 113 of the right side, the left side, the upper side, and the lower side of the metal housing body 110 of the receptacle 100 are respectively connected to the left plate 213, the right plate 214, the upper plate 215, and the lower plate 216 of the metal housing component 210 of the plug 200 in a tight fit manner to clamp and fix the plug 200 which matches and is plugged in the receptacle 100. Compared to the prior electrical connector, e.g. a USB connector, of which the upper sides and the lower sides of the housing bodies of the receptacle and the plug are not connected to each other in a tight fit manner, the housing bodies of the plug 200 and the receptacle 100 of the present invention, i.e. the metal housing component 210 of the plug 200 and the metal housing body 110 of the receptacle 100, have a better shielding design and cause minimal radio frequency interference to prevent interference between devices. In addition, two troughs 219 are further disposed on the left plate 213 and on the right plate 214 of the metal housing component 210 of the plug 200. The troughs 219 can incorporate with the elastic arms 113 disposed on the left side and the right side of the metal housing body 110 of the receptacle 100 to provide a feel of a click when the plug 200 is being coupled with or being detached from the receptacle 100, to improve the stability of the connection therein in a tight fit manner.

The plug 200 further comprises a first accommodating housing 261, a second accommodating housing 262, a circuit board 270, a protective housing 280, and wires 290. The first accommodating housing 261 and the second accommodating housing 262 are connected to each other to form an accommodating housing. A front end of the accommodating housing is coupled with a back end of the metal housing component 210. The circuit board 270 is disposed in the accommodating housing. The circuit board 270 serves as a connecting structure for connecting the wires 290 to the first elastic terminals 230 and the second elastic terminals 240. Therefore, the first elastic terminals 230, the second elastic terminals 240, and the wires 290 are disconnected minimally. The first accommodating housings 261 and the second accommodating housings 262 respectively comprise clamping parts 263, 264 to clamp and fix the wires 290. Therefore, the wires 290 are disconnected minimally. The protective housing 280 is disposed outside the accommodating housing to protect components therein and to clamp and fix the wires 290. In the embodiment, the plug 200 is, but is not limited to, assembled with the wires 290 to compose a connecting line product. In another embodiment, a storage device can be disposed on the circuit board which serves as a connecting structure for connecting the storage device to the first elastic terminals and the second elastic terminals, and the plug is assembled with the storage device to compose a flash drive product.

Figure 6:
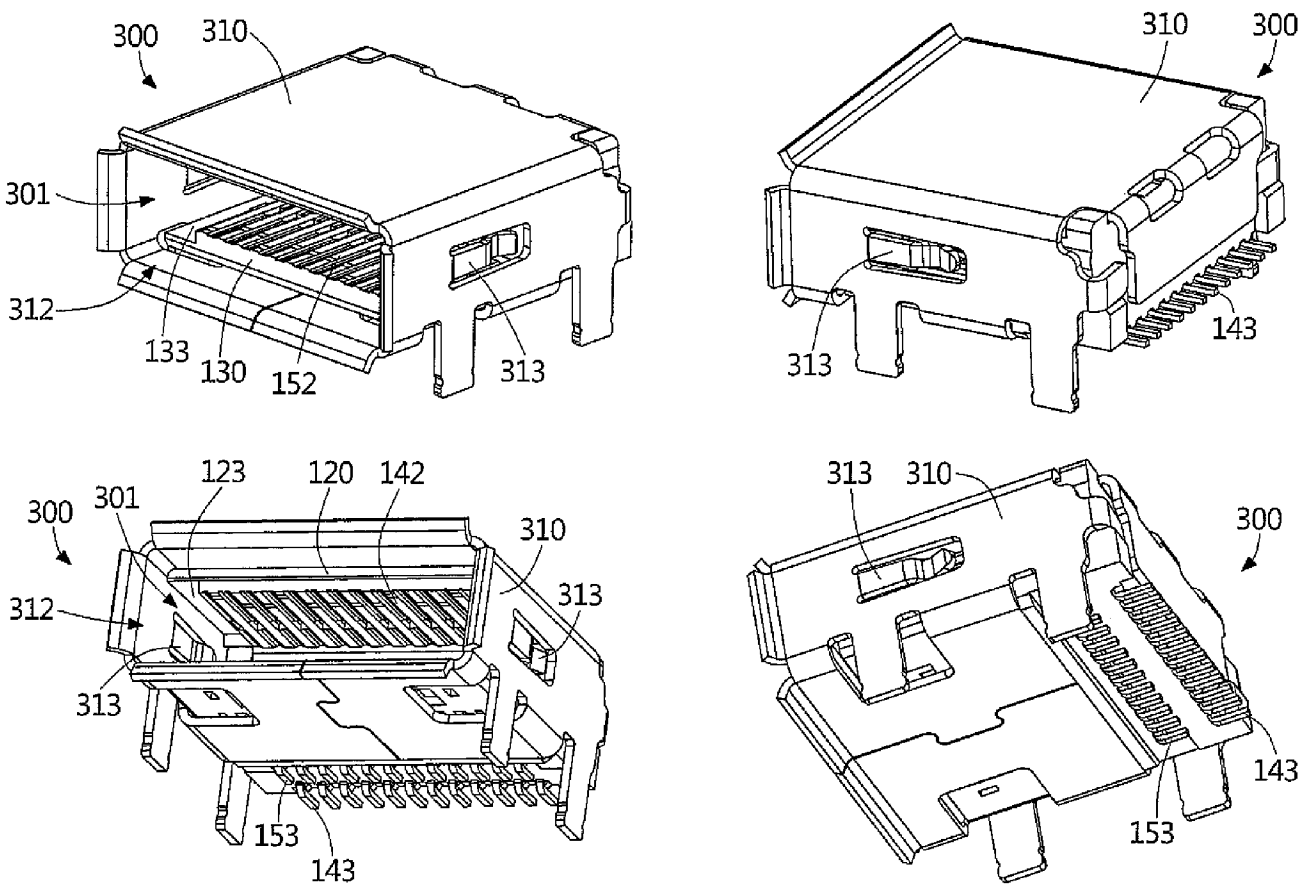
FIG. 6 is a diagram with different angles of view of a receptacle of an electrical connector according to the second embodiment of the present invention.
Figure 7:
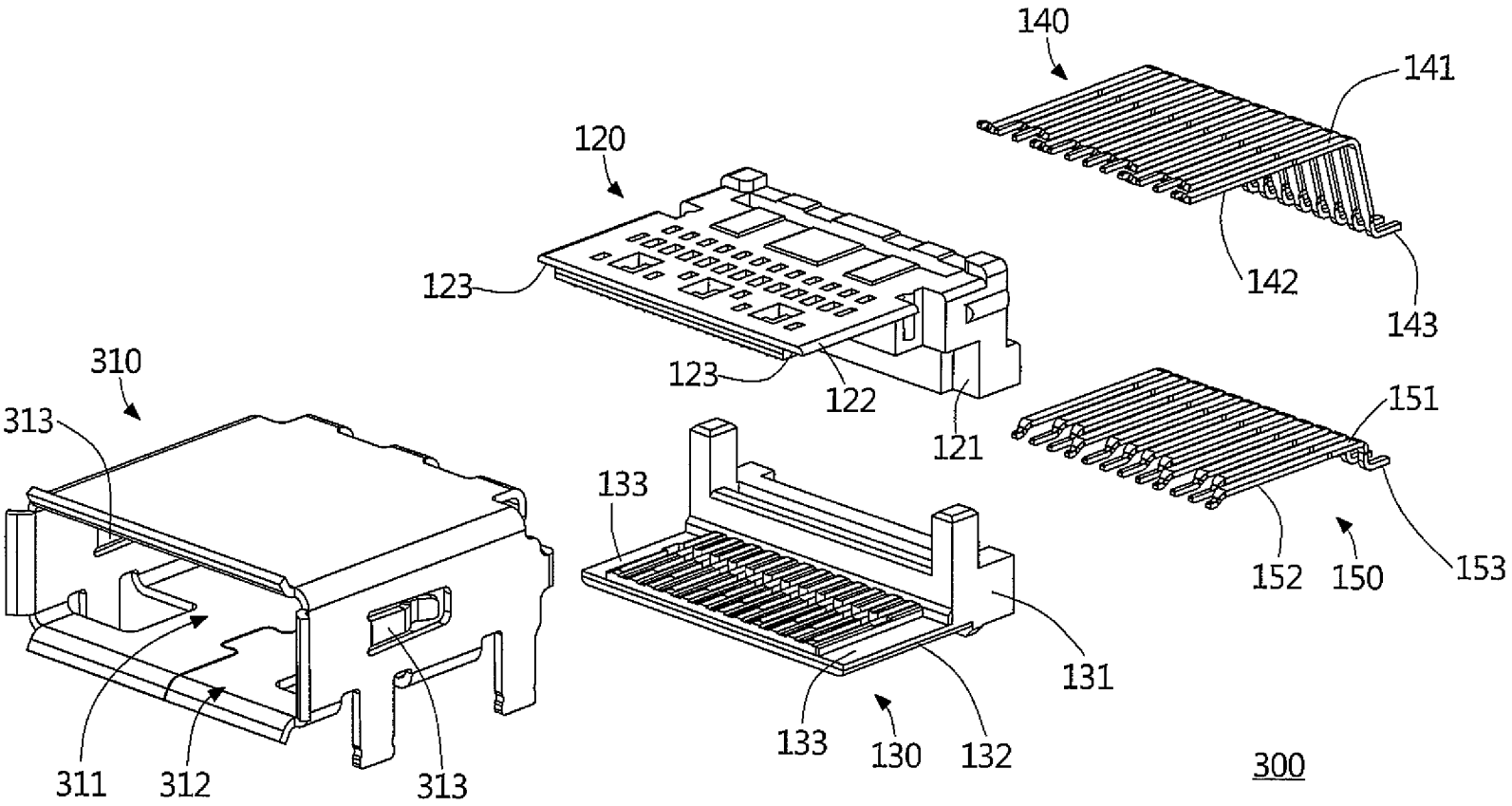
FIG. 7 is an exploded view of the receptacle of the electrical connector according to the second embodiment of the present invention.

As shown in FIG. 6 and FIG. 7, a receptacle 300 of an electrical connector according to the second embodiment of the invention comprises a metal housing body 310, a first plastic body 120, a second plastic body 130, a plurality of first flat terminals 140 and a plurality of second flat terminals 150. The differences between the receptacle 300 of the second embodiment and the receptacle 100 of the first embodiment, as shown in FIG. 1 to FIG. 3, are merely in regard to metal housing bodies. The metal housing body 310 comprises an accommodating space 311 and an opening 312 connecting the accommodating space 311. The plastic main body formed by the first plastic body 120 and the second plastic body 130 is positioned in the accommodating space 311 of the metal housing body 310 and incorporates with the metal housing body 310 to form an accommodating space 301. The plug matching the receptacle 300 can be inserted through the opening 312 of the metal housing body 310 and be plugged in the accommodating space 301. A left side and a right side of the metal housing body 310 respectively comprise at least one elastic arm 313 utilized for clamping and fixing the plug which matches and is plugged in the receptacle 300. Compared to the metal housing body 110, as shown in FIG. 1 to FIG. 3, an upper side and a lower side of the metal housing body 310 do not comprise elastic arms. Instead, an upper side and a lower side of the plug matching the receptacle 300 comprise elastic arms for clamping and fixing.

Figure 8:
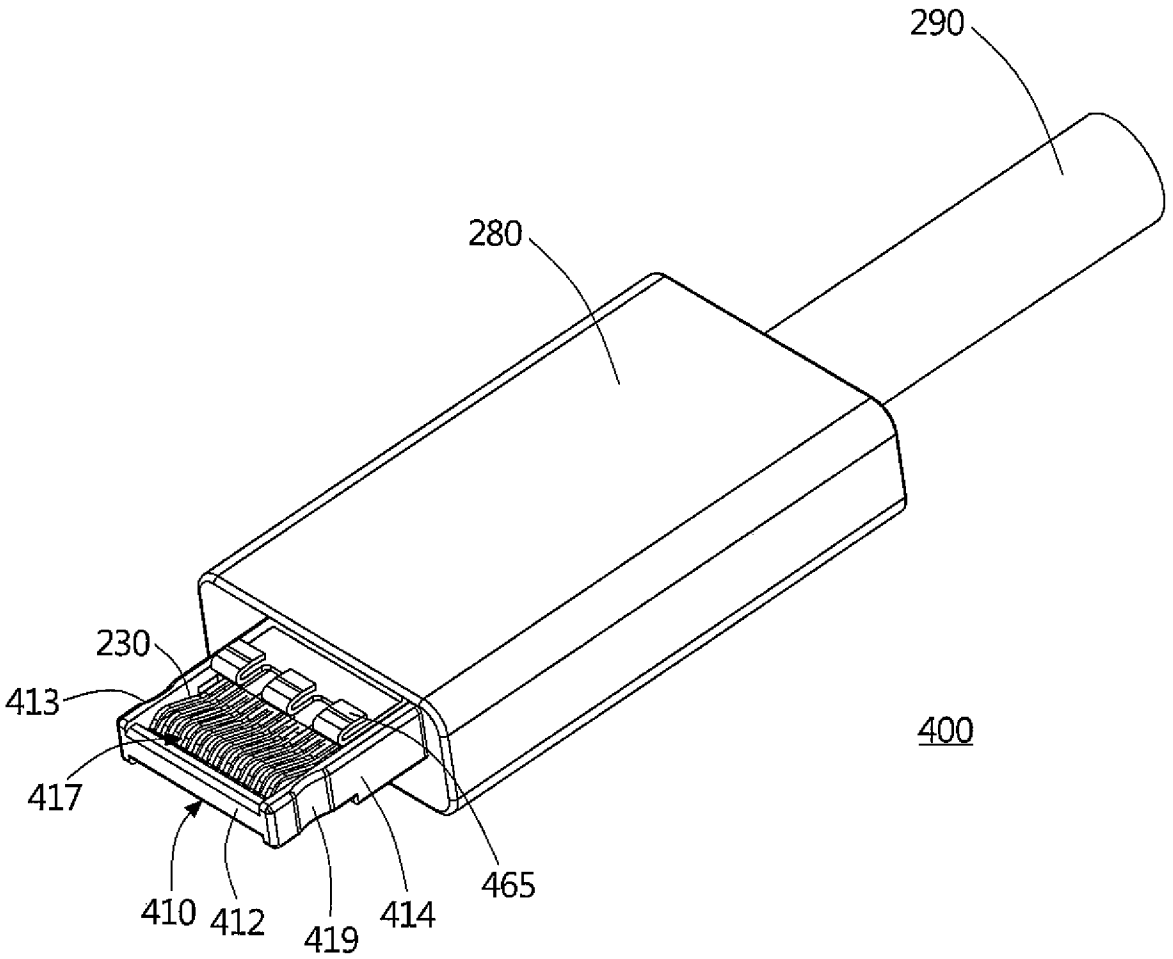
FIG. 8 is a diagram of a plug of the electrical connector according to the second embodiment of the present invention.
Figure 9:
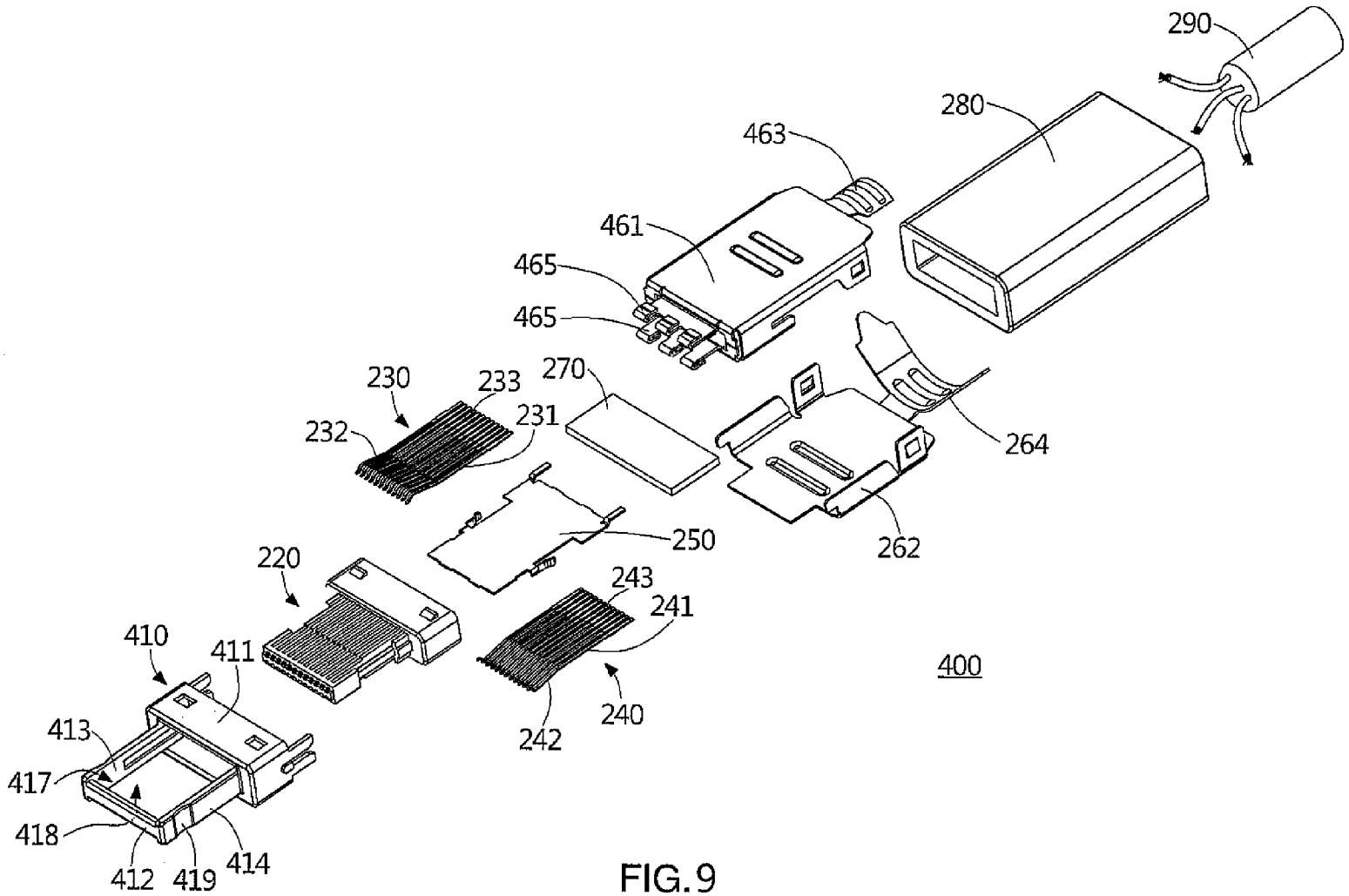
FIG. 9 is an exploded view of the plug of the electrical connector according to the second embodiment of the present invention.

As shown in FIG. 8 and FIG. 9, a plug 400 of an electrical connector according to the second embodiment of the invention matches the receptacle 300. The plug 400 comprises a metal housing component 410, a plastic component 220, a plurality of first elastic terminals 230, a plurality of second elastic terminals 240, a metal shielding plate 250, a first accommodating housing 461, a second accommodating housing 262, a circuit board 270, a protective housing 280, and wires 290. The differences between the plug 400 of the second embodiment and the plug 200 of the first embodiment, as shown in FIG. 4 and FIG. 5, are in regard to metal housing components and first accommodating housings.

The metal housing component 410 comprises a housing 411, a front plate 412, a left plate 413, and a right plate 414. Each of the front plate 412, the left plate 413, and the right plate 414 comprises a first edge, a second edge, a third edge, and a fourth edge. The first edge and the second edge are opposite each other, and the third edge and the fourth edge are opposite each other. Two ends of the first edge are respectively connected to one end of the third edge and to one end of the fourth edge, and two ends of the second edge are respectively connected to the other ends of the third edge and the fourth edge. A left edge and a right edge of an opening at the front of the housing 411 are respectively connected to the first edges of the left plate 413 and the right plate 414. The second edges of the left plate 413 and the right plate 414 are respectively connected to the first edge and the second edge of the front plate 412. An upper edge of the opening at the front of the housing 411, the third edges of the left plate 413 and the right plate 414, and the third edge of the front plate 412 incorporate with each other to form a first opening 417. A lower edge of the opening at the front of the housing 411, the fourth edges of the left plate 413 and the right plate 414, and the fourth edge of the front plate 412 incorporate with each other to form a second opening 418.

The first accommodating housing 461 and the second accommodating housing 262 are connected to each other to form an accommodating housing. A front end of the accommodating housing is coupled with a back end of the metal housing component 410. The first accommodating housings 461 and the second accommodating housings 262 respectively comprise clamping parts 463, 264 to clamp and fix the wires 290. Therefore, the wires 290 are hardly disconnected minimally. In addition, elastic arms 465 respectively extend from an upper edge and a lower edge at the front of the first accommodating housing 461 in a forward direction.

When the plug 400 of the invention is plugged in the receptacle 300, the elastic arms 313 of the right side and the left side of the metal housing body 310 of the receptacle 300 are respectively connected to the left plate 413 and the right plate 414 of the metal housing component 410 of the plug 400 in a tight fit manner. The upper side and the lower side of the metal housing body 310 of the receptacle 300 are respectively connected to the elastic arms 465 of the upper edge and the lower edge at the front of the first accommodating housing 461 of the plug 400 in a tight fit manner, to clamp and fix the plug 400 which matches and is plugged in the receptacle 300. Compared to the prior electrical connector, e.g. a USB connector, of which the upper sides and the lower sides of housing bodies of the prior receptacle and the prior plug are not connected to each other in a tight fit manner, the housing bodies of the plug 400 and the receptacle 300 of the present invention, i.e. the accommodating housing of the plug 400 and the metal housing body 310 of the receptacle 300, have better a shielding design and cause minimal radio frequency interference, to prevent interference between devices.

In addition, two troughs 419 are further disposed on the left plate 413 and on the right plate 414 of the metal housing component 410 of the plug 400. The troughs 419 can incorporate with the elastic arms 313 disposed on the left side and the right side of the metal housing body 310 of the receptacle 300 to provide a feel of a click when the plug 400 is being coupled with or being detached from the receptacle 300, to improve stability of connection therein in a tight fit manner. Although the elastic arms 465 extend from the upper and lower edges at the front of the first accommodating housing 461 of the plug 400 in the embodiment, the elastic arms 465 can be replaced by other elastic arms extending from the upper and the lower edges of the opening at the front of the housing of the metal housing component as long as the elastic arms do not contact the first elastic terminals 230 and the second elastic terminals 240.

Figure 10:
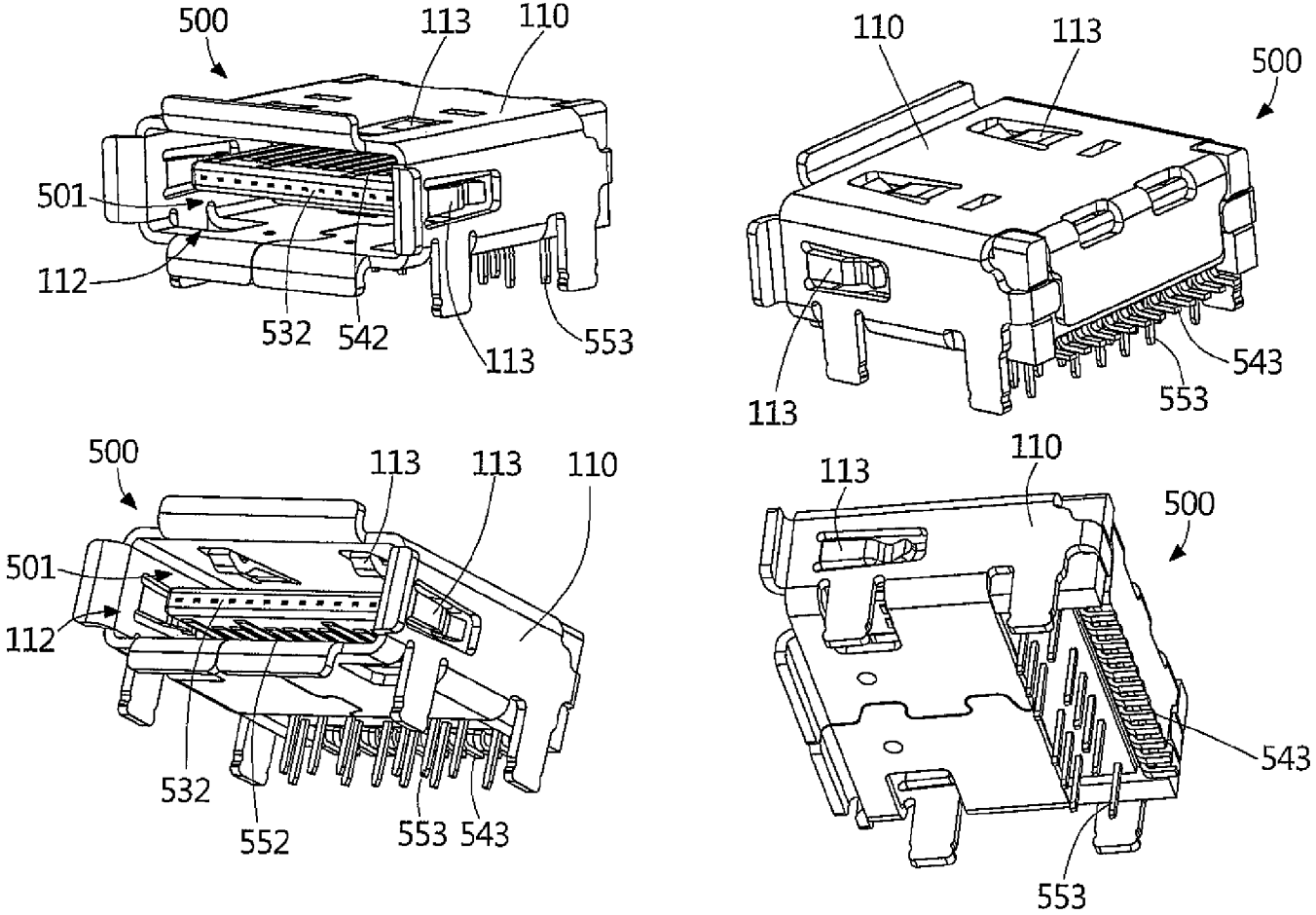
FIG. 10 is a diagram with different angles of view of a receptacle of an electrical connector according to the third embodiment of the present invention.
Figure 11:
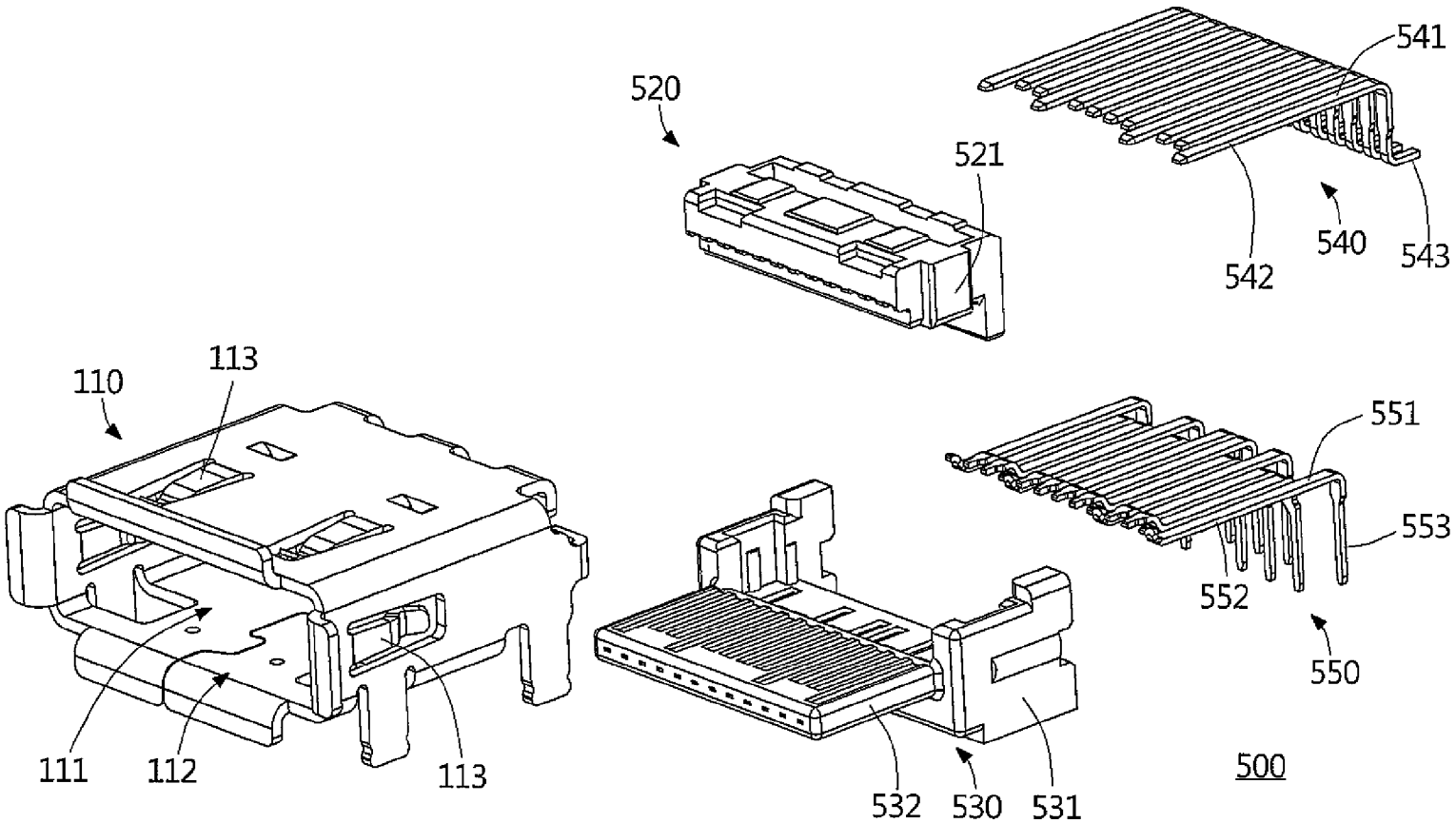
FIG. 11 is an exploded view of the receptacle of the electrical connector according to the third embodiment of the present invention.

As shown in FIG. 10 and FIG. 11, a receptacle 500 of an electrical connector according to the third embodiment of the invention comprises a metal housing body, a plastic main body, and a plurality of flat terminals. The metal housing body of the third embodiment is the same as the metal housing body 110, as shown in FIG. 1 to FIG. 3. In addition, the plastic main body comprises a first plastic body 520 and a second plastic body 530. The flat terminals comprise, but are not limited to, a plurality of first flat terminals 540 and a plurality of second flat terminals 550.

For example, a plastic main body can be formed as a one-piece component instead of being formed by connecting the first plastic body 520 to the second plastic body 530. The first plastic body 520 comprises a first connecting part 521. The second plastic body 530 comprises a second connecting part 531 and a tongue part 532 extending from a middle of the second connecting part 531 in a forward direction. The first plastic body 520 and the second plastic body 530 are connected to each other by the first connecting part 521 and to the second connecting part 531 to form the plastic main body. The plastic main body is positioned in the accommodating space 111 of the metal housing body 110 and incorporates with the metal housing body 110 to form an accommodating space 501. A plug matching the receptacle 500 can be inserted through the opening 112 of the metal housing body 110 and be plugged in the accommodating space 501.

Each first flat terminal 540 comprises a fixing part 541, a contacting part 542, and a soldering part 543. The fixing part 541 is fixed in the first connecting part 521. The contacting part 542 extends from the fixing part 541 in a forward direction to form a flat shape. The contacting part 542 is disposed on an upper side of the tongue part 532 and is exposed to the accommodating space 501 in an upward direction. The soldering part 543 extends from the fixing part 541 in a downward direction and outside the first connecting part 521. Each second flat terminal 550 comprises a fixing part 551, a contacting part 552, and a soldering part 553. The fixing part 551 is fixed in the second connecting part 531. The contacting part 552 extends from the fixing part 551 in a forward direction to form a flat shape. The contacting part 552 is disposed on a lower side of the tongue part 532 and is exposed to the accommodating space 501 in a downward direction. The soldering part 553 extends from the fixing part 551 in a downward direction and outside the second connecting part 531.

Each of the terminals of the receptacle 500 of the invention, i.e. the first flat terminals 540 and the second flat terminals 550, has a flat shape. Compared to the prior electrical connector, e.g. the USB connector, in which the terminals comprise elastic terminals, the terminals of the receptacle 500 of the invention are only minimally damaged due to abnormal usage, such as plugging a plug in an unmatched receptacle, to prevent the expensive cost of repairing a damaged receptacle.

In the embodiment, signals provided by the first flat terminals 540 of the receptacle 500 are the same as those provided by the second flat terminals 550 of the receptacle 500. The alignment sequence of the first flat terminals 540 compared to that of the second flat terminals 550 is in reverse order. Therefore, the plug matching the receptacle 500 can be plugged therein and works well whether or not the plug is upside down. The first flat terminals 540 are, but are not limited to, fixed in the first plastic body 520 of the plastic main body in an insert molding manner. The second flat terminals 550 are, but are not limited to, fixed in the second plastic body 530 of the plastic main body in an assembly manner. In another embodiment, the first flat terminals are fixed in the plastic main body in an assembly manner, and/or the second flat terminals are fixed in the plastic main body in an insert molding manner. The soldering parts of the first flat terminals 540 utilize, but are not limited to, a SMT manner, and the soldering parts of the second flat terminals 550 utilize, but are not limited to, a DIP manner. In another embodiment, the soldering parts of the first flat terminals can utilize a DIP manner, and/or the soldering parts of the second flat terminals can utilize a SMT manner.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A receptacle for an electrical connector comprising:

a metal housing body;

a plastic main body positioned in the metal housing body and incorporating with the metal housing body to form an accommodating space, wherein the accommodating space is utilized for being plugged into by a plug, wherein the plastic main body comprises a first tongue part and a second tongue part; and a plurality of flat terminals, wherein the plurality of flat terminals comprises a plurality of first flat terminals and a plurality of second flat terminals, wherein each flat terminal comprises:

a fixing part, a contacting part, and a soldering part;

wherein the fixing part is fixed in the plastic main body, the contacting part extends from the fixing part in a forward direction to form a flat shape and is exposed to the accommodating space, wherein the soldering part extends from the fixing part in a downward direction and outside the plastic main body; wherein signals provided by the plurality of first flat terminals are the same as those provided by the plurality of second flat terminals, wherein an alignment sequence of the plurality of first flat terminals compared to that of the plurality of second flat terminals is in reverse order; wherein the contacting part of each first flat terminal is disposed on a lower side of the first tongue part and is exposed to the accommodating space in a downward direction, wherein the contacting part of each second flat terminal is disposed on an upper side of the second tongue part and is exposed to the accommodating space in an upward direction.

2. The receptacle for the electrical connector of claim 1, wherein the plurality of flat terminals is fixed in the plastic main body in an insert molding manner.

3. The receptacle for the electrical connector of claim 1, wherein the plurality of flat terminals is fixed in the plastic main body in an assembly manner.

4. The receptacle for the electrical connector of claim 1, wherein the soldering parts of the plurality of first flat terminals and the plurality of second flat terminals utilize a surface mounting technology manner.

5. The receptacle for the electrical connector of claim 1, wherein the soldering parts of the plurality of first flat terminals and the plurality second flat terminals utilize a dual in-line package manner.

6. The receptacle for the electrical connector of claim 1, wherein the soldering parts of the plurality of first flat terminals utilize a surface mount technology manner and the soldering parts of the plurality of second flat terminals utilize a dual in-line package manner.

7. The receptacle for the electrical connector of claim 1, wherein the plastic main body comprises a first plastic body and a second plastic body, wherein the first plastic body comprises a first connecting part and the first tongue part extending from an upper edge of the first connecting part in a forward direction, wherein the second plastic body comprises a second connecting part and the second tongue part extending from a lower edge of the second connecting part in a forward direction, wherein the first plastic body and the second plastic body are connected to each other by the first connecting part and the second connecting part to form the plastic main body; wherein the fixing part of each first flat terminal is fixed in the first connecting part, wherein the soldering part of each first flat terminal extends from the fixing part in a downward direction and outside the first connecting part; wherein the fixing part of each second flat terminal is fixed in the second connecting part, and wherein the soldering part of each second flat terminal extends from the fixing part in a downward direction and outside the second connecting part.

8. The receptacle for the electrical connector of claim 7, wherein the plug comprises:

a metal housing component comprising a housing, a front plate, a left plate, a right plate, an upper plate, and a lower plate, wherein each of the front plate, the left plate, the right plate, the upper plate, and the lower plate comprises a first edge, a second edge, a third edge, and a fourth edge; wherein the first edge and the second edge are opposite each other, wherein the third edge and the fourth edge are opposite each other, wherein two ends of the first edge are respectively connected to one end of the third edge and to one end of the fourth edge, wherein two ends of the second edge are respectively connected to other ends of the third edge and the fourth edge; wherein a left edge and a right edge of an opening at a front of the housing are respectively connected to the first edges of the left plate and the right plate, wherein the second edges of the left plate and the right plate are respectively connected to the first edge and the second edge of the front plate, wherein an upper edge and a lower edge of the opening at the front of the housing are respectively connected to the first edges of the upper plate and the lower plate, wherein the third edge and the fourth edge of the upper plate are respectively connected to parts of the third edges of the left plate and the right plate, wherein the third edge and the fourth edge of the lower plate are respectively connected to parts of the fourth edges of the left plate and the right plate; wherein the second edge of the upper plate, other parts of the third edges of the left plate and the right plate, and the third edge of the front plate incorporate with each other to form a first opening, and wherein the second edge of the lower plate, other parts of the fourth edges of the left plate and the right plate, and the fourth edge of the front plate incorporate with each other to form a second opening;

a plastic component inserted into an opening at a back of the housing and disposed in the metal housing component;

a plurality of first elastic terminals, wherein each first elastic terminal is disposed on an upper side of the plastic component and comprises:

a fixing part, a contacting part, and a soldering part;

wherein the fixing part of each first elastic terminal is fixed in the plastic component, wherein the contacting part of each first elastic terminal extends from the fixing part of each first elastic terminal in a forward direction to form an elastic arm shape, is exposed to the first opening in an upward direction, and is not higher than the third edges of the left plate and the right plate, and wherein the soldering part of each first elastic terminal extends from the fixing part of each first elastic terminal in a backward direction and outside the plastic component;

a plurality of second elastic terminals, wherein each second elastic terminal is disposed on a lower side of the plastic component and comprises:

a fixing part, a contacting part, and a soldering part;

wherein the fixing part of each second elastic terminal is fixed in the plastic component, wherein the contacting part of each second elastic terminal extends from the fixing part of each second elastic terminal in a forward direction to form an elastic arm shape, is exposed to the second opening in a downward direction, and is not lower than the fourth edges of the left plate and the right plate, and wherein the soldering part of each second elastic terminal extends from the fixing part of each second elastic terminal in a backward direction and outside the plastic component; and a metal shielding plate disposed in the plastic component and positioned between the plurality of first elastic terminals and the plurality of second elastic terminals;

wherein a plurality of elastic arms is respectively disposed on a right side, on a left side, and on at least one of an upper side and a lower side of the metal housing body of the receptacle, with the plug plugged in, the receptacle is connected to the left plate, the right plate, and at least one of the upper plate and the lower plate of the metal housing component of the plug in a tight fit manner; wherein two first troughs are respectively disposed on two sides of a lower side of the first tongue part, wherein two second troughs are respectively disposed on two sides of an upper side of the second tongue part, with the plug plugged in the receptacle, the first troughs and the second troughs of the receptacle respectively accommodate the third edges and the fourth edges of the left plate and the right plate of the metal housing component of the plug.

9. The receptacle for the electrical connector of claim 7, wherein the plug comprises:

a metal housing component comprising:

a housing, a front plate, a left plate, and a right plate, wherein each of the front plate, the left plate, and the right plate comprises a first edge, a second edge, a third edge, and a fourth edge; wherein the first edge and the second edge are opposite each other, wherein the third edge and the fourth edge are opposite each other, wherein two ends of the first edge are respectively connected to one end of the third edge and to one end of the fourth edge, wherein two ends of the second edge are respectively connected to other ends of the third edge and the fourth edge; wherein a left edge and a right edge of an opening at a front of the housing are respectively connected to the first edges of the left plate and the right plate, wherein the second edges of the left plate and the right plate are respectively connected to the first edge and the second edge of the front plate; wherein an upper edge of the opening at the front of the housing, the third edges of the left plate and the right plate, and the third edge of the front plate incorporate with each other to form a first opening, and wherein a lower edge of the opening at the front of the housing, the fourth edges of the left plate and the right plate, and the fourth edge of the front plate incorporate with each other to form a second opening;

a plastic component inserted in an opening at a back of the housing and disposed in the metal housing component;

a plurality of first elastic terminals, wherein each first elastic terminal is disposed on an upper side of the plastic component and comprises:

a fixing part, a contacting part, and a soldering part;

wherein the fixing part of each first elastic terminal is fixed in the plastic component, wherein the contacting part of each first elastic terminal extends from the fixing part of each first elastic terminal in a forward direction to form an elastic arm shape, is exposed to the first opening in an upward direction, and is not higher than the third edges of the left plate and the right plate, and wherein the soldering part of each first elastic terminal extends from the fixing part of each first elastic terminal in a backward direction and outside the plastic component;

a plurality of second elastic terminals, wherein each second elastic terminal is disposed on a lower side of the plastic component and comprises:

a fixing part, a contacting part, and a soldering part;

wherein the fixing part of each second elastic terminal is fixed in the plastic component, wherein the contacting part of each second elastic terminal extends from the fixing part of the second elastic terminal in a forward direction to form an elastic arm shape, is exposed to the second opening in a downward direction, and is not lower than the fourth edges of the left plate and the right plate, and wherein the soldering part of each second elastic terminal extends from the fixing part of each second elastic terminal in a backward direction and outside the plastic component; and a metal shielding plate disposed in the plastic component and positioned between the plurality of first elastic terminals and the plurality of second elastic terminals;

wherein a plurality of elastic arms is disposed on a right side and a left side of the metal housing body of the receptacle, with the plug plugged in the receptacle, the receptacle is connected to the left plate and the right plate of the metal housing component of the plug in a tight fit manner; wherein two first troughs are disposed on a lower side of the first tongue part and are opposite each other, and wherein two second troughs are disposed on an upper side of the second tongue part and are opposite each other, with the plug plugged in the receptacle, the first troughs and the second troughs of the receptacle respectively accommodate the third edges and the fourth edges of the left plate and the right plate of the metal housing component of the plug.

10. The receptacle for the electrical connector of claim 9, wherein the plug further comprises an accommodating housing, a front end of the accommodating housing is coupled with a back end of the metal housing component, and wherein two of the plurality of elastic arms respectively extend from an upper edge and a lower edge of the accommodating housing in a forward direction; with the plug is plugged in the receptacle, the plug is connected to an upper side and a lower side of the metal housing body in a tight fit manner.

11. The receptacle for the electrical connector of claim 9, wherein two of the plurality of elastic arms respectively extend from the upper edge and the lower edge of the opening at the front of the housing of the metal housing component in a forward direction; with the plug plugged in the receptacle, the plug is connected to an upper side and a lower side of the metal housing body in a tight fit manner.

12. A receptacle for an electrical connector comprising:

a metal housing body;

a plastic main body positioned in the metal housing body and incorporating with the metal housing body to form an accommodating space, wherein the accommodating space is plugged into by a plug, wherein the plastic main body comprises a tongue part; and a plurality of flat terminals, wherein the plurality of flat terminals comprises a plurality of first flat terminals and a plurality of second flat terminals, wherein each flat terminal comprises:

a fixing part, a contacting part, and a soldering part;

wherein the fixing part is fixed in the plastic main body, wherein the contacting part extends from the fixing part in a forward direction to form a flat shape and is exposed to the accommodating space, wherein the soldering part extends from the fixing part in a downward direction and outside the plastic main body; wherein signals provided by the plurality of first flat terminals are the same as those provided by the plurality of second flat terminals, wherein an alignment sequence of the plurality of first flat terminals compared to that of the plurality of second flat terminals is in reverse order; wherein the contacting part of each first flat terminal is disposed on an upper side of the tongue part and is exposed to the accommodating space in an upward direction, wherein the contacting part of each second flat terminal is disposed on a lower side of the tongue part and is exposed to the accommodating space in a downward direction.

13. The receptacle for the electrical connector of claim 12, wherein the plastic main body comprises a first plastic body and a second plastic body, wherein the first plastic body comprises a first connecting part, wherein the second plastic body comprises a second connecting part and the tongue part extending from a middle of the second connecting part in a forward direction, wherein the first plastic body and the second plastic body are connected to each other by the first connecting part and the second connecting part to form the plastic main body; wherein the fixing part of each first flat terminal is fixed in the first connecting part, wherein the soldering part of each first flat terminal extends from the fixing part of each first flat terminal in a downward direction and outside the first connecting part; wherein the fixing part of each second flat terminal is fixed in the second connecting part, and wherein the soldering part of each second flat terminal extends from the fixing part of each second flat terminal in a downward direction and outside the second connecting part.

14. The receptacle for the electrical connector of claim 12, wherein the plurality of flat terminals is fixed in the plastic main body in an insert molding manner.

15. The receptacle fir the electrical connector of claim 12, wherein the plurality of flat terminals is fixed in the plastic main body in an assembly manner.

16. The receptacle for the electrical connector of claim 12, wherein the soldering parts of the plurality of first flat terminals and the plurality of second flat terminals utilize a surface mount technology manner.

17. The receptacle for the electrical connector of claim 12, wherein the soldering parts of the plurality of first flat terminals and the plurality second flat terminals utilize a dual in-line package manner.

18. The receptacle for the electrical connector of claim 12, wherein the soldering parts of the plurality of first flat terminals utilize a surface mounting technology manner and the soldering parts of the plurality of second flat terminals utilize a dual in-line package manner.

19. The receptacle for the electrical connector of claim 12, wherein the plastic main body comprises:

a first plastic body comprising a first connecting part; and a second plastic body comprising a second connecting part and the tongue part extending from a middle of the second connecting part in a forward direction, wherein the first plastic body and the second plastic body are connected to each other by the first connecting part and the second connecting part to form the plastic main body, and wherein the fixing part of the first flat terminal is fixed in the first plastic body of the plastic main body, and the fixing part of the second flat terminal is fixed in the second plastic body of the plastic main body.

* * * * *